US007766172B2

(12) United States Patent
Spangenberger et al.

(10) Patent No.: US 7,766,172 B2
(45) Date of Patent: Aug. 3, 2010

(54) FRICTION BASED MATERIAL SORTER

(75) Inventors: Jeffrey S. Spangenberger, Plainfield, IL (US); Edward J. Daniels, Orland Park, IL (US); Bassam J. Jody, Tinley Park, IL (US); Joseph A. Pomykala, Jr., Shorewood, IL (US)

(73) Assignee: UChicago Argonne, LLC, Chicago, IL (US)

( * ) Notice: Subject to any disclaimer, the term of this patent is extended or adjusted under 35 U.S.C. 154(b) by 0 days.

(21) Appl. No.: 12/356,564

(22) Filed: Jan. 21, 2009

(65) Prior Publication Data

US 2009/0188842 A1 Jul. 30, 2009

Related U.S. Application Data

(60) Provisional application No. 61/024,618, filed on Jan. 30, 2008.

(51) Int. Cl.
*B07C 1/00* (2006.01)

(52) U.S. Cl. ..... 209/691; 209/665; 209/689; 209/692; 209/695

(58) Field of Classification Search ..... 209/689, 209/691, 692, 695
See application file for complete search history.

(56) References Cited

U.S. PATENT DOCUMENTS

| | | | | |
|---|---|---|---|---|
| 527,657 A | | 10/1894 | Borchard | |
| 780,508 A | | 1/1905 | King | |
| 1,538,660 A | | 5/1925 | Sager | |
| 3,665,555 A | * | 5/1972 | Willis | 452/19 |
| 3,909,398 A | * | 9/1975 | Leonard | 209/156 |
| 5,005,258 A | * | 4/1991 | Griffis | 452/18 |
| 2003/0089644 A1 | * | 5/2003 | Hanks | 209/665 |

* cited by examiner

*Primary Examiner*—Gene Crawford
*Assistant Examiner*—Terrell H Matthews
(74) *Attorney, Agent, or Firm*—Joan Pennington

(57) ABSTRACT

A method and apparatus are provided for separating elastomeric materials from mixed material streams. A separator includes a bank of parallel rollers extending longitudinally between a first end and a second end. The bank of parallel rollers having a predefined inclination with the first end elevated higher than the second end. Mixed material streams are fed onto a top surface of the high end of the inclined parallel rollers. A material having less friction and elasticity slides down the inclined roller bank top surface are collected into a collection bin positioned adjacent the second, lower end of the roller bank. Other materials having a higher friction coefficient grip the rollers more and are lifted out of the valley due to friction migrating perpendicular to the rotating rollers and are collected in a collection bin positioned adjacent one side of the roller bank parallel to the longitudinal roller axis.

18 Claims, 12 Drawing Sheets

FRICTION BASED MATERIAL SORTER

This application claims the benefit of U.S. Provisional Application No. 61/024,618 filed on Jan. 30, 2008.

CONTRACTUAL ORIGIN OF THE INVENTION

The United States Government has rights in this invention pursuant to Contract No. W-31-109-ENG-38 between the United States Government and The University of Chicago and/or pursuant to Contract No. DE-AC02-06CH11357 between the United States Government and UChicago Argonne, LLC representing Argonne National Laboratory.

FIELD OF THE INVENTION

The present invention relates to an improved method and apparatus for separating materials from shredder residue and other waste streams. More specifically, this invention relates to an improved method and apparatus for separating elastomeric materials from mixed material streams.

DESCRIPTION OF THE RELATED ART

The usage of elastomer including rubber products in automobiles continues to increase. Additionally, more shredder yards in the United States are shredding vehicles with tires remaining on them. This increases the amount of rubber found in shredder residue. When the polymers are separated from the shredder residue in processes such as provided at a mechanical separation plant at Argonne National Laboratory, almost all of the rubber reports to the polymer concentrate fraction. In some residues, rubber constituted over 50% of the polymer concentrate by weight.

A need exists for an effective method and mechanism to recover polymers from shredder residue, which are currently disposed of in landfills. Known sink float processes, including froth flotation, separate the polymer concentrate into potentially recyclable plastics streams. These streams typically are contaminated with different amounts of elastomeric materials. These materials can reduce the quality and value of the recovered plastics. In addition, an elastomeric stream could prove to be a product of value. Therefore, it would be advantageous to find a method to separate these materials from the recovered plastics.

It is desirable to provide such a process that can be installed to separate the rubber from the polymer concentrate before it is fed to the flotation system or used to purify individual products. If the former is used, less material will enter the flotation system reducing the size and cost of the flotation process.

U.S. Pat. No. 7,255,233, issued to Daniels et al. on Aug. 14, 2007 and assigned to the present assignee, discloses a method and apparatus for separating mixed plastics using flotation techniques including a first stage initial washing tank for washing of incoming plastics and providing a first separation process and at least one separation module. The first stage initial washing tank includes a perforated basket to hold heavy materials, such as metals, glass, and the like. Each separation module includes a separation tank, a feeding section for feeding of mixed stream into the separation tank; and a collecting section for collecting of the separated mixed plastics including floaters and sinkers from the separation tank. The separation tank has no moving parts. Each separation tank and the first stage initial washing tank is a standard off-the-shelf circular tank with a flat bottom. Washing and drying steps are eliminated between separation stages. Batch processing is replaced with generally continuous operation. An integrated vibrating screen and air classification system is provided.

U.S. Pat. No. 5,653,867, issued to Jody et al. on Aug. 5, 1997 and assigned to the present assignee, discloses an improved method for separating acrylonitrile butadiene styrene (ABS) and high impact polystyrene (HIPS) plastics from each other. The ABS and HIPS plastics are shredded to provide a selected particle size. The shredded particles of the ABS and HIPS plastics are applied to a solution having a solution density in a predefined range between 1.055 gm/cm-.sup.3 and 1.07 gm/cm.sup.3, a predefined surface tension in a range between 22 dynes/cm to 40 dynes/cm and a pH in the range of 1.77 and 2.05. The disclosed method separates ABS and HIPS, two solid thermoplastics which have similar densities, by selectively modifying the effective density of the HIPS using a binary solution with the appropriate properties, such as pH, density and surface tension, such as a solution of acetic acid and water or a quaternary solution having the appropriate density, surface tension, and pH.

U.S. Pat. No. 6,599,950, issued to Jody et al. on Jul. 29, 2003 and assigned to the present assignee, discloses a method of separating a portion of acrylonitrile-butadiene-styrene (ABS) from a mixture containing ABS and for separating a portion of ABS and polycarbonate (PC) from a mixture of plastics containing ABS and PC. The method includes shredding and/or granulating the mixture of plastics containing ABS and PC to provide a selected particle size; sequentially dispersing the shredded mixture of plastics in a series of aqueous solutions having different specific gravities and separating the floating fraction until the desired separation is obtained. Surface tension and pH are also variables to be controlled.

Principal objects of the present invention are to provide an improved method and apparatus for separating elastomeric materials from mixed material streams.

Other objects of the present invention are to provide an improved method and apparatus for separating elastomeric materials from mixed material streams based upon frictional and elastic material characteristics.

Important aspects of the present invention are to provide a dry method and apparatus for separating elastomeric materials from mixed material streams substantially without negative effect and that overcome some of the disadvantages of prior art arrangements.

SUMMARY OF THE INVENTION

In brief, a method and apparatus are provided for separating elastomeric materials from mixed material streams, such as polymeric rich waste streams. A separator includes a bank of parallel rollers extending longitudinally between a first end and a second. The bank of parallel rollers having a predefined inclination with the first end elevated higher than the second end. Mixed material streams are fed onto a top surface of the high end of the inclined parallel rollers. A material having less friction and elasticity slides down the inclined roller bank top surface is collected into a collection bin positioned adjacent the second, lower end of the roller bank. Other materials having a higher friction coefficient grip the rollers more are lifted out of the valley due to friction and migrate in a perpendicular direction to the rotating rollers and are collected in a collection bin positioned adjacent one side, or at the end of the roller bank next to, and in the direction of elastomeric migration, the other collection bin, of the roller bank parallel to the longitudinal roller axis.

In accordance with features of the invention, the rollers are formed of carbon steel. Differing deck geometry of the bank of parallel rollers is provided to change material flow characteristics for certain mixed material streams. The bank of parallel rollers has a predefined roller diameter and spacing between the rollers determined based on the geometry of the particles that are being separated. An optimum length of the rollers is predetermined based on the properties of the material in the stream that is to be separated. Changing the deck speed is selectively provided to affect the material separation. The rollers typically are closely spaced so the materials cannot fall between the rollers; or alternatively small thin objects are allowed to fall through.

BRIEF DESCRIPTION OF THE DRAWINGS

The present invention together with the above and other objects and advantages may best be understood from the following detailed description of the preferred embodiments of the invention illustrated in the drawings, wherein.

DETAILED DESCRIPTION OF THE PREFERRED EMBODIMENTS

In accordance with features of the invention, a dry mechanical process using a separator including a bank of rollers has been invented to reduce the cost of separating the elastomers from the non-elastomers. After unsuccessfully searching for off-the-shelf roller-type machinery that would accomplish this task, a separator developed by the inventors has been tested on a bench scale apparatus having a capacity of 250 pounds/hour.

While the separator or rollers generally are not effective in separating the wood from the plastics, a color sorter can be used to remove the wood; currently removing the majority of the rubber and wood from the polyolefin product stream is through a wet process. For example, this wet process produces a 95% Polypropylene (PP)/Polyethylene (PE) product with about 5% rubber in it. This wet process contributes significant cost to the overall recovery of this product stream.

In accordance with features of the invention, the separator or roller system advantageously separates rubber from mixed material streams at significantly less cost. Mixed material streams contain various amounts of elastomeric materials, which typically reduce the quality, and value of a conventional recovered stream. The recovered plastics and recyclable polymer materials generally have improved quality and increased value, and also the recovered elastomeric materials may prove to be a valuable product.

Figure 1:
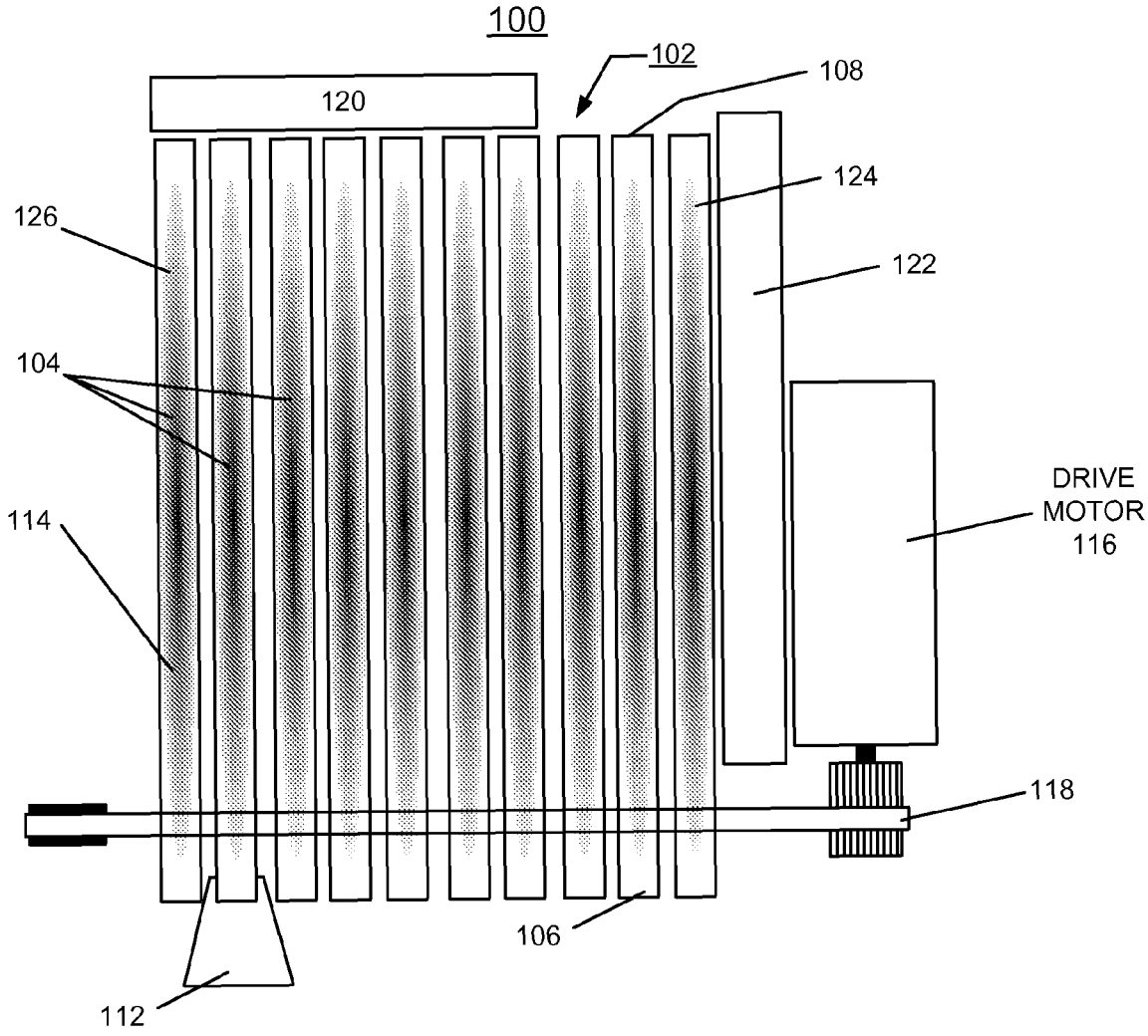
FIG. 1 is a top view not to scale illustrating exemplary apparatus for separating elastomeric materials from mixed material streams in accordance with the present invention.
Figure 2:
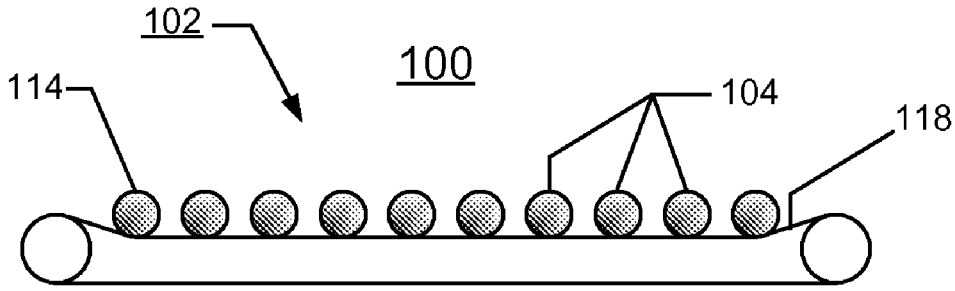
FIG. 2 is an end view of the apparatus for separating elastomeric materials from mixed material streams of FIG. 1 in accordance with the present invention.
Figure 3:
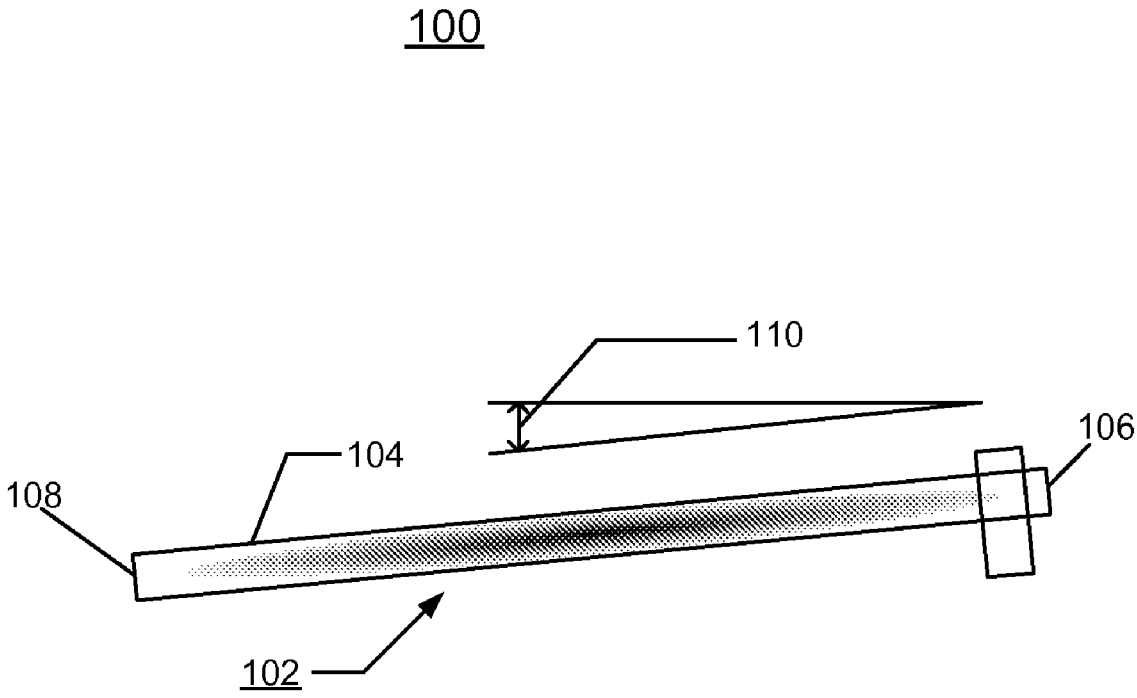
FIG. 3 is a side view of the apparatus for separating elastomeric materials from mixed material streams of FIG. 1 in accordance with the present invention.

Having reference now to the drawings, in FIGS. 1, 2, and 3 there is shown exemplary apparatus or a separation module for separating elastomeric materials from mixed material streams generally designated by the reference character 100 in accordance with the present invention.

Separator 100 includes a bank 102 of parallel rollers 104 extending longitudinally between a first end 106 and a second end 108. The bank of parallel rollers having a predefined inclination indicated by arrow 110 in FIG. 3 with the first end 106 elevated above the second end 108. A feed supply 112 feeds materials from the mixed material stream on a top surface 114 near the first end 106 of the bank 102 of inclined parallel rollers 104.

Separator 100 includes a drive motor 116 with a drive belt 118 or associated drive gear 118 cooperatively rotating the parallel rollers 104. The rollers 104 are closely spaced so that the mixed stream materials generally cannot fall between the rollers 104.

In accordance with features of the invention, separator 100 separates material based on frictional and elastic characteristics. The mixed stream materials are fed onto the high end 106 of the inclined parallel rollers 104 and a material having less friction and elasticity with the roller surface material is more likely to remain in the valley of two adjacent rollers 104. These pieces of material slide down the incline top surface 114 and eventually fall off of the second, lower end 108 of the roller bank 102 into a collection bin 120 positioned adjacent the second end 108. The collection bin 120 should be understood to broadly include a conveyor and other collection device. Other materials that grip the rollers 104 more are lifted out of the valley due to friction and migrate in the same direction as the rotating rollers 104 and are collected in a collection bin 122 positioned adjacent a first side 124 of the roller bank 102. An opposing second side 126 of the roller bank is located near the feed supply 112.

Laboratory Testing of the Roller Separator

To test the mechanical rubber separation process we developed a limited parametric experimental matrix to determine the impact of three major parameters on the performance of the process. These parameters are: the roller diameter, roller tip speed and inclination angle. A roller diameter for the bank of cooperatively rotated parallel rollers is selectively provided to affect material separation by inherently changing the dimension of the valley between the rollers. Also in general the effect of selectively using different roller materials is to provide a way to change the frictional characteristics between the material and the roller. Two roller diameters (1 and 1⅜ inches) and three roller tip speeds (110 ft/min, 210 ft/min and 340 ft/min) were tested. The performance of the roller system was also evaluated at four inclination angles (2½, 5, 7½ and 10 degrees). The test matrix used a typical polymer concentrate derived from shredder residue containing approximately 30% rubber. Tests were also conducted using the following fractions produced by the froth flotation process.

1). Polypropylene (PP)/Polyethylene (PE) concentrate containing 24% rubber;

2). Acrylonitrile butadiene styrene (ABS) concentrates containing 40% and 24% rubber;

3). ABS/Polycarbonate (PC) concentrate containing 57% rubber; and

4) Reject fraction from wet purification process of PP/PE.

Testing was performed using mixed material streams having a particle size between about ⅛ inch and ½ inch; however, it should be understood that materials of almost any size could be separated by operating the separator 100 with different hardware and configuration and at different operating conditions.

The performance is determined based on percent of total rubber removed and percent of total loss of the targeted plastics (PP/PE, ABS, PS and ABS/PC) with the separated rubber. Performance when targeting rubber as a product is based on purity of the rubber product and the amount of rubber loss.

Experimental Results

The equipment used for testing had a pre-selected spacing between the rollers. This gap is selected such that it allows a quantity of small and thin material to fall through. In some instances this material is undesirable and can be discarded, however some of the thin material would be considered a loss. The gap width used for the 1⅜" roller deck incorporated a 0.070-inch gap width, which resulted in an average of about 7% material loss on the first pass of material. The gap width used for the 1" roller deck used a 0.040-inch gap width, which led to only a 2% loss on the first pass. This fine material is roughly 50% plastic and 10% each of rubber, metal, wood, foam, and other material. This shows that a smaller gap width is desirable.

The experimental results are summarized in Appendix A. The roller system has not yet been optimized. The results obtained when the rollers were used to separate rubber from the polymer concentrate proved that:

1. The process separates over 70% of the rubber from the polymer concentrate with about 15% loss of the plastics to the rubber stream in a single pass. This produced an upgraded plastics concentrate containing less than 10% rubber. About ⅓ of the lost plastics were PP, PE and PP/PE.

2. The removal of rubber before introducing the polymer concentrate to the froth flotation system would decrease the required size of the froth flotation system by 20%-30%.

3. The rollers succeeded in separating over 75% of the rigid urethanes with the rubber fraction in some instances but were not effective in separating the wood.

4. The purity of the plastics fraction can be increased to nearly 100%, however this will increase the loss of the plastics to the rubber stream. For example, a 98% rubber free stream was produced with a single pass, but with only a 43% yield of plastic.

5. Increasing the diameter of the rollers from 1" to 1⅜" resulted in less of the rubber being separated from the plastics and more loss of the plastics to the rubber fraction. However, the smaller rollers need to run at such a slow speed that the flow rate is severely reduced and material flow characteristics are impaired.

6. Increasing the inclination angle increases through put of the system. Plastic yields increased from 73% to 90% with increasing inclination angle while rubber contamination in the plastics fraction rose from 8% to 14%.

7. Passing the rubber stream over a second set of rollers to recover some of the lost plastics resulted in the recovery of roughly 40% of the lost plastics in the first pass. The plastics stream produced by the second set of rollers contained about 30% rubber.

8. When the plastics stream from the second pass is mixed with the plastics stream from the first pass the overall loss of plastics decreased to under 20%, and the combined plastics stream contained 67% plastics and 9% rubber.

It should be understood that an optimum inclination angle and roller speed combination advantageously is selectively provided as to be determined for particular mixed material streams.

Preliminary tests using the roller separation system as a purification step for the PP/PE concentrate has shown the following results after a single pass over the rollers:

1. Increased the PP/PE concentration from 69% to 84%.

2. Reduced the rubber content of the stream from 24% to 8% rubber while losing 6% of the PP/PE.

3. About 10% of the rigid urethane was separated with the rubber fraction.

Preliminary tests using the roller separation system as a means to recover a rubber concentrate from the wet PP/PE purification reject stream has shown the following results:

1. The rubber fraction has a purity of over 90% rubber species.

2. 70% of the rubber, that otherwise would have been rejected, has been recovered and may prove to be a marketable product stream.

Preliminary tests using the roller separation system as a purification step for the PC-ABS/PC concentrate has shown the following results after a single pass over the rollers:

1. 88% of the rubber in this stream was removed.

2. PC-ABS/PC concentration increased from 39% to 77%.

3. The rubber fraction contained 93% rubber, which may be a usable product.

In conclusion, tests conducted so far proved the technical feasibility of using rollers to separate rubber from polymer concentrates derived from shredder residue or from plastics derived from polymer concentrates. The use of this equipment can minimize the equipment size required downstream, upgrade current product streams to contain less rubber contamination, and produce new rubber product streams which do not currently exist in the base process. Over 70% of the rubber can be separated from the polymer concentrate in a single pass. The plastic product streams can be upgraded to contain less than 10% rubber. The rubber rich streams can also be upgraded using the rollers to produce a potential rubber product fraction containing less than 10% non-rubber material.

With respect to FIGS. 4-13, and the references to non-rubber should be understood to mean that non-rubber includes anything in the material mix that is not elastic, such as plastic, rock, metal, and foam.

Figure 4:
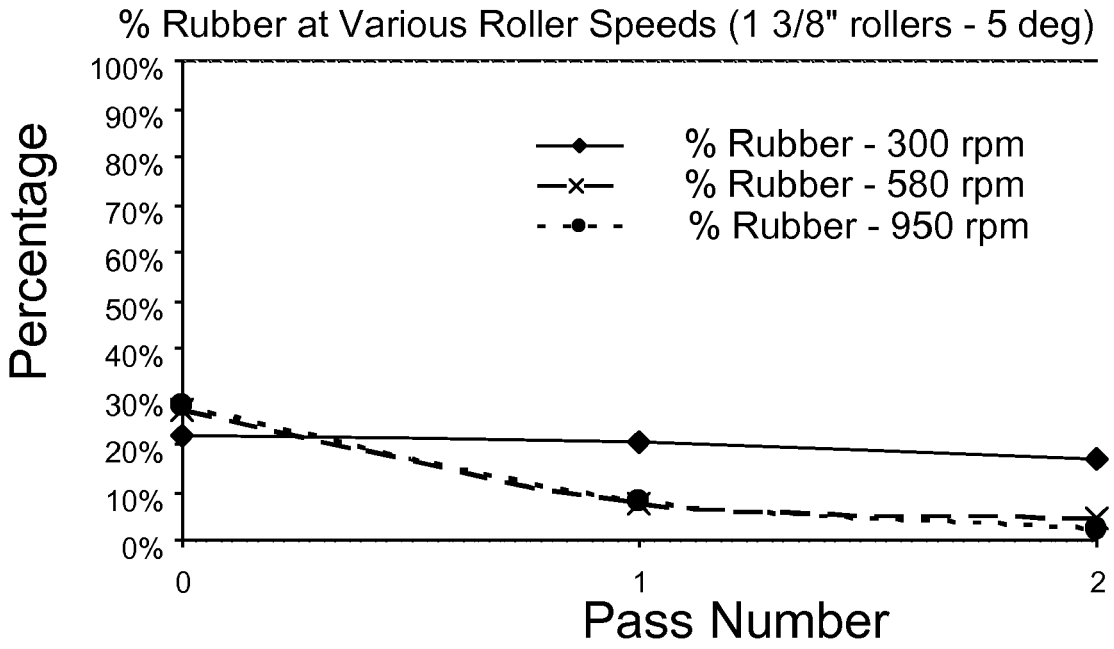
FIGS. 4, 5, and 6 provide exemplary operational charts with multiple roller speeds and a first roller diameter.
Figure 5:
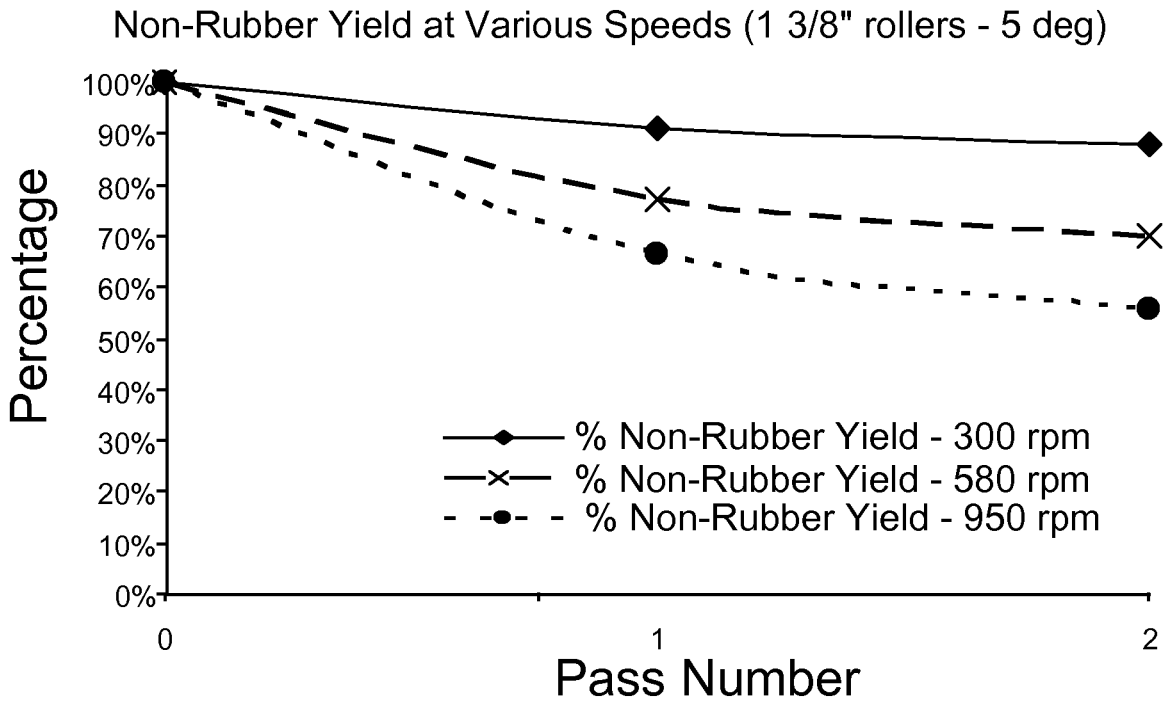
Figure 6:
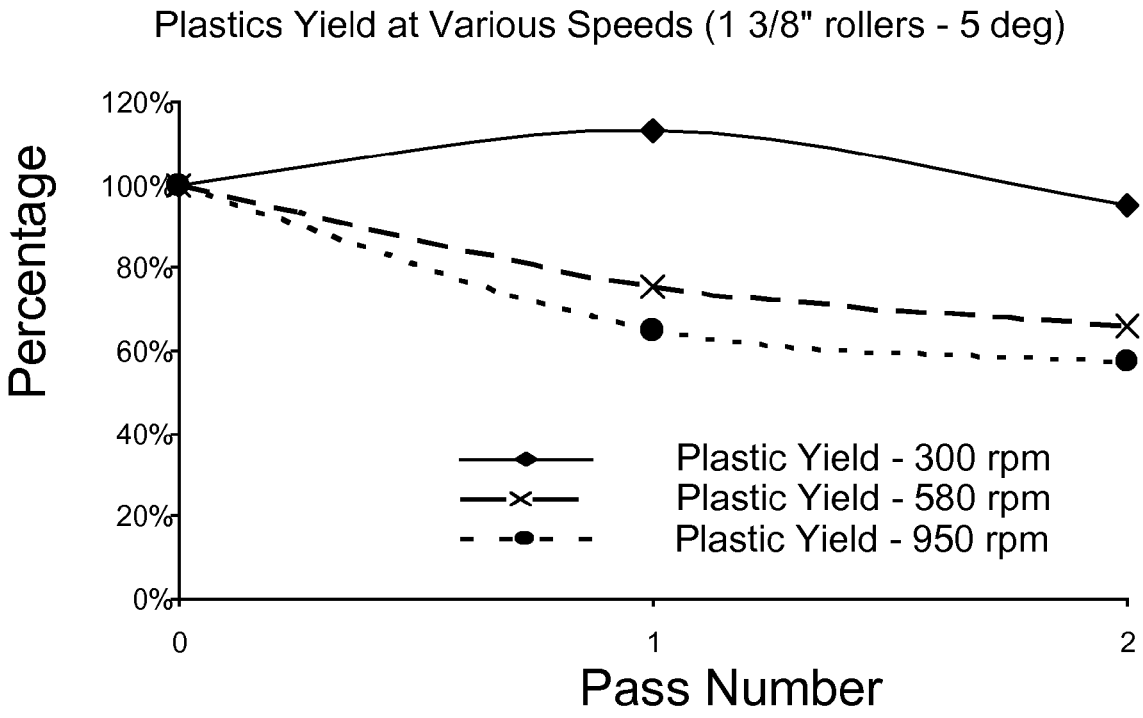

FIGS. 4, 5, and 6 provide exemplary operational charts with multiple roller speeds of 300 revolutions per minute (RPM), 580 RPM, and 950 RPM, and a first roller diameter of 1⅜ inches. The illustrated operational relationships are provided with a 5-degree bank angle. Note that FIG. 6 shows a yield of plastic to be 113% after the first pass. This, being an impossible outcome, is due to a large weight of metal in the starting material's sample. Because of the high density of the metal compared to that of plastic and the small size of the analyzed sample, a single large piece of metal made a significant reduction in the weight percent of the plastics. On metal free basis the yield is 100.3%, indicating that there is effectively no plastic loss. Larger sample sizes would mitigate this, however, the sample sizes were determined, in part, by the amount of resources and time available for analysis.

Figure 7:
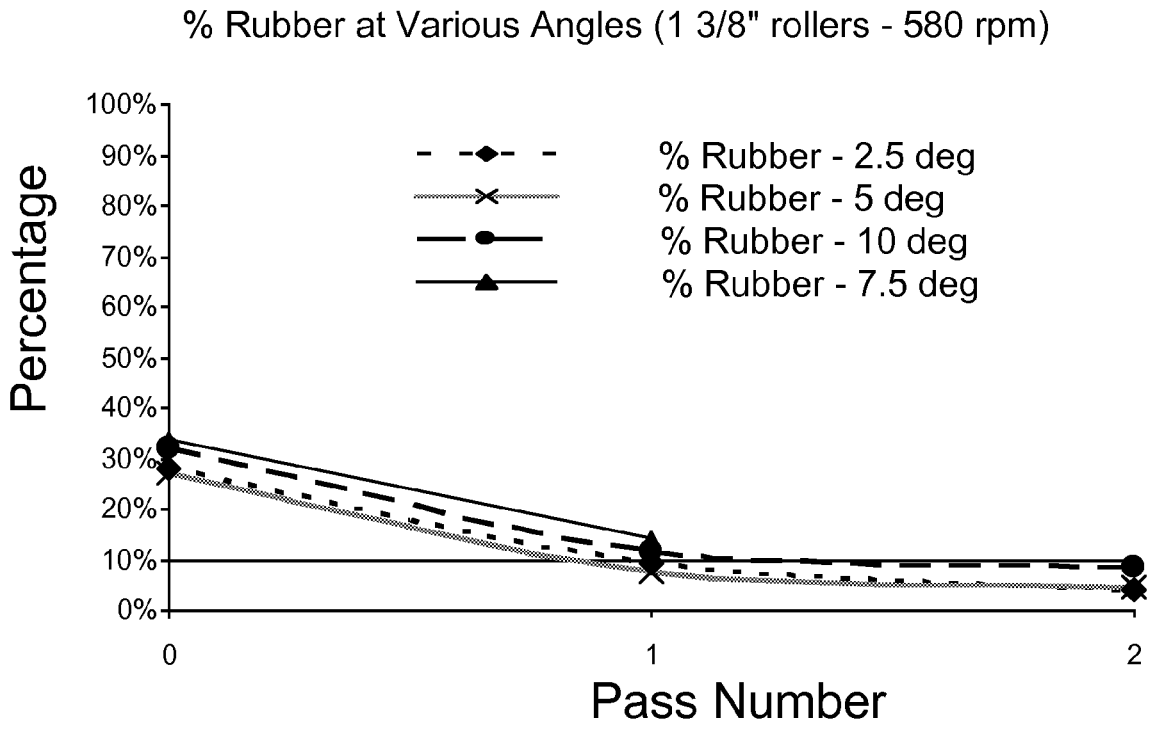
FIGS. 7, 8, and 9 provide exemplary operational charts with multiple inclination angles and the first roller diameter.
Figure 8:
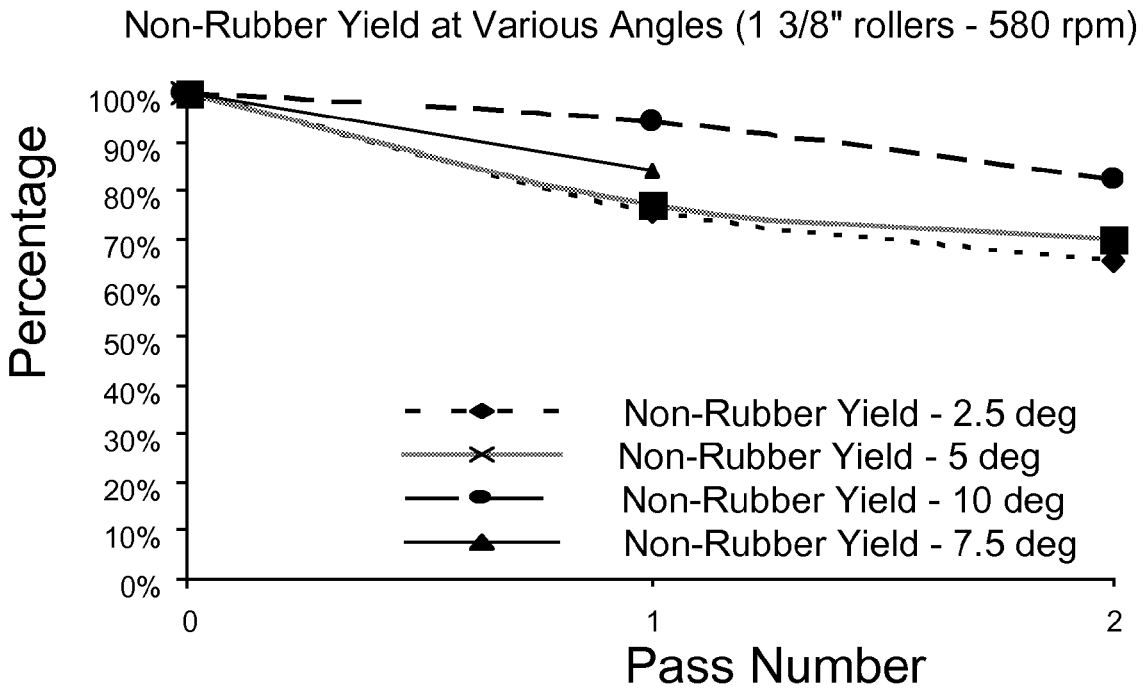
Figure 9:
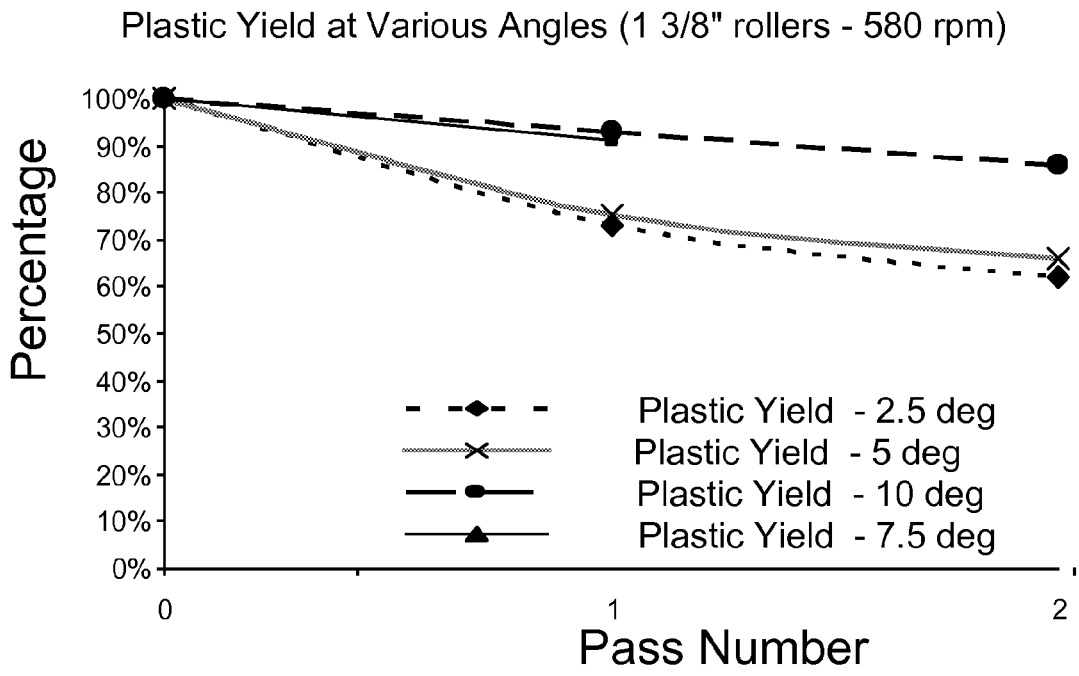

FIGS. 7, 8, and 9 provide exemplary operational charts with multiple inclination angles of 2.5, 5, 10, and 7.5 degree bank angles, and the first roller diameter of 1⅜ inches.

Figure 10:
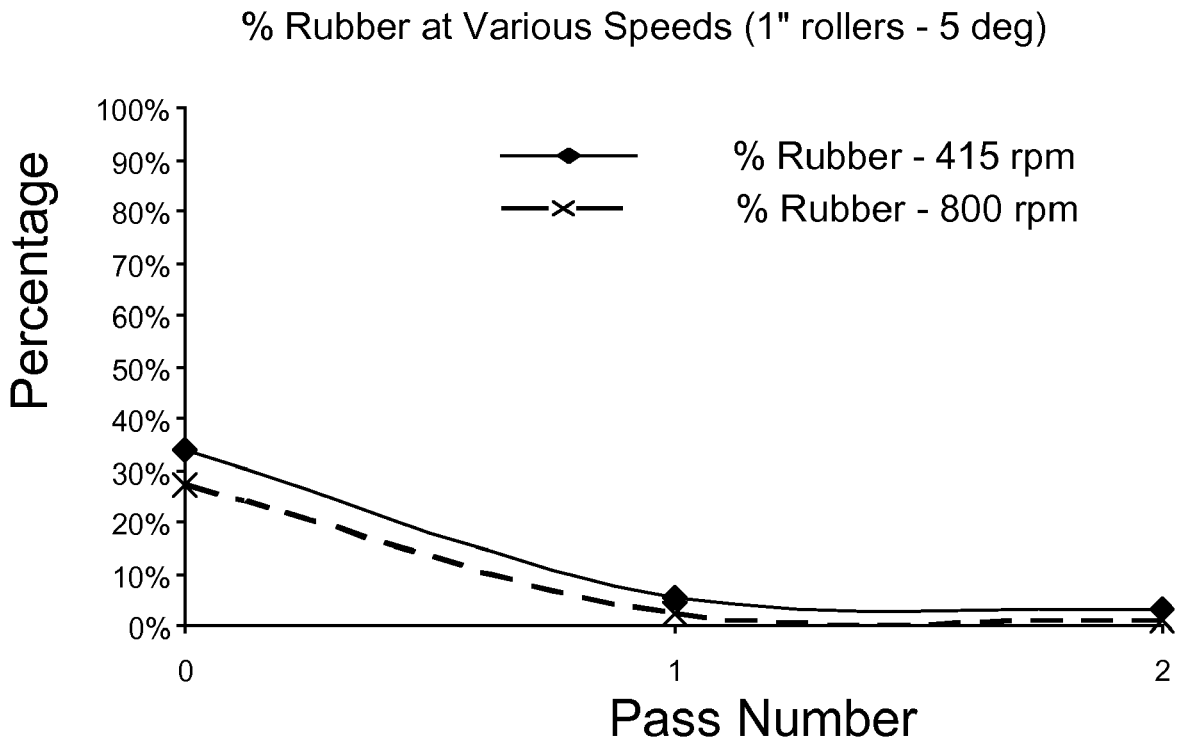
FIGS. 10, 11, and 12 provide exemplary operational charts with multiple roller speeds and another roller diameter.
Figure 11:
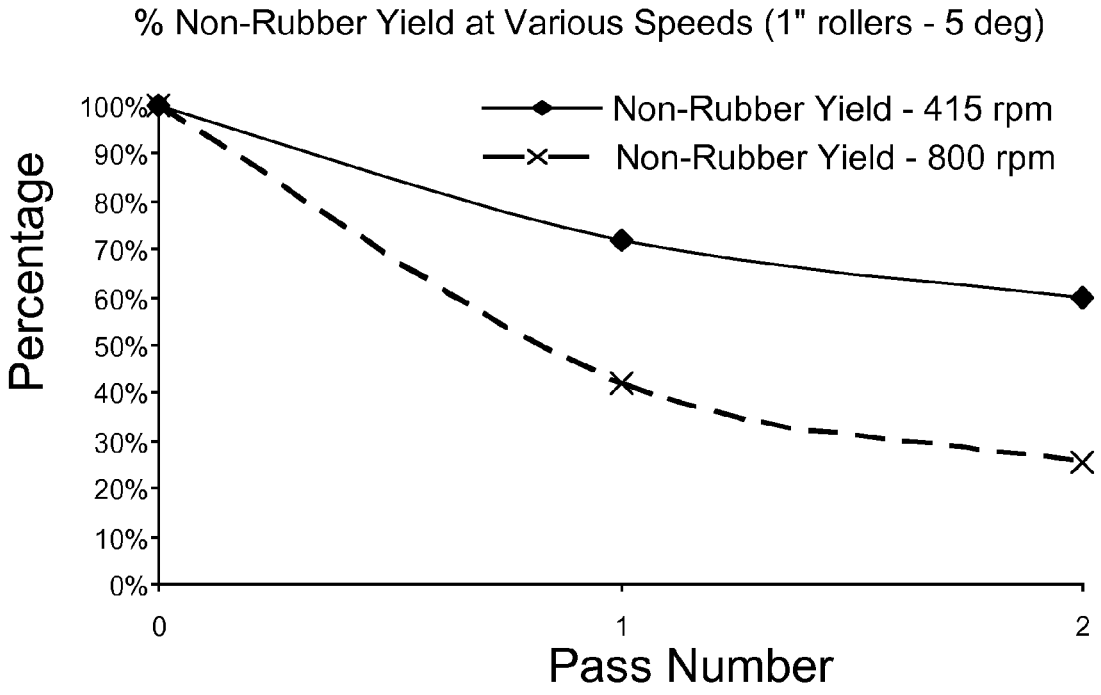
Figure 12:
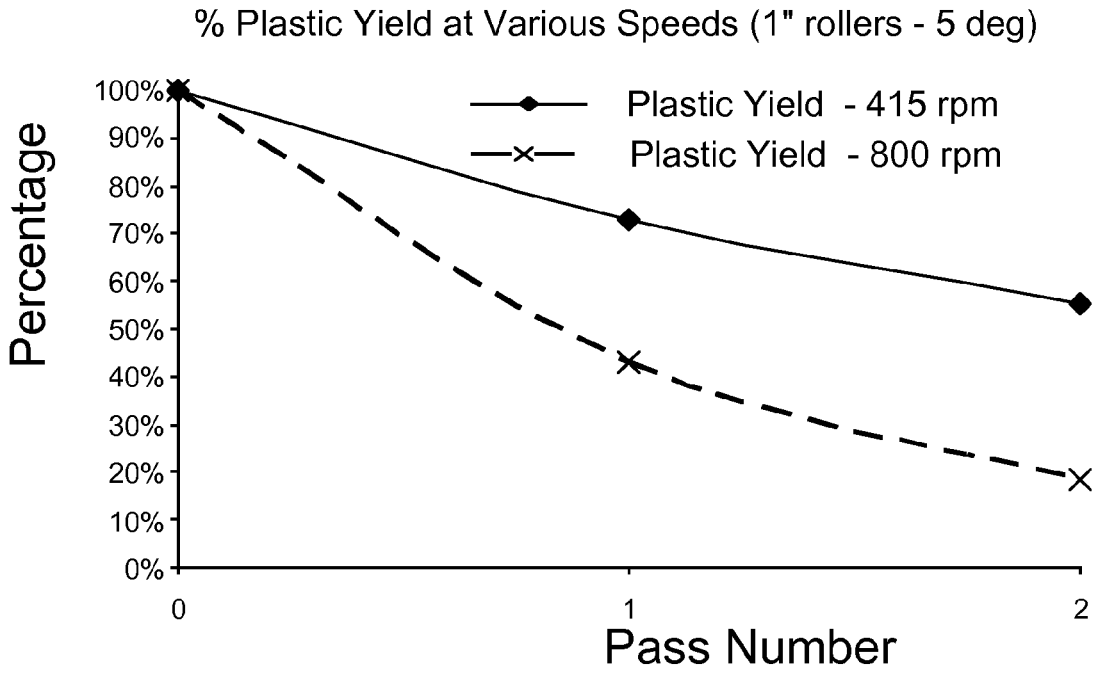

FIGS. 10, 11, and 12 provide exemplary operational charts with multiple roller speeds and a second roller diameter of 1 inch and a 5-degree bank angle.

Figure 13:
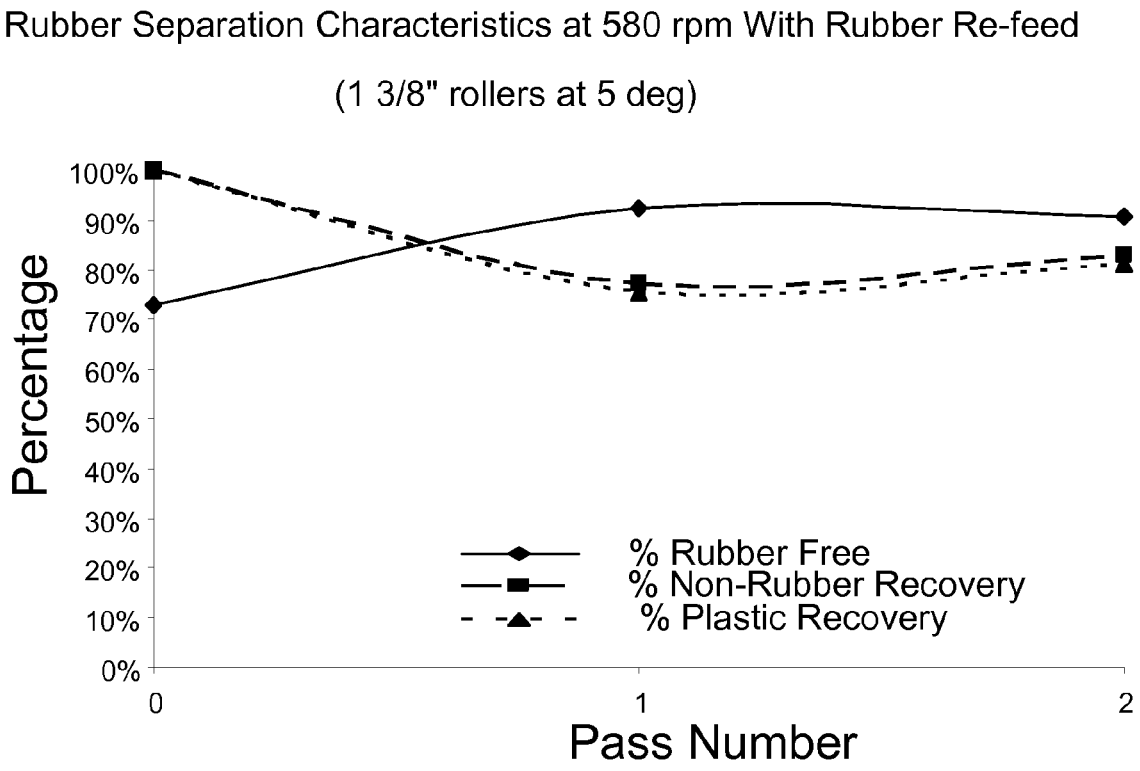
FIG. 13 provides exemplary operational charts illustrating the effect of combining rubber separation characteristics at a set speed with rubber re-feed.

FIG. 13 provides exemplary operational charts illustrating the effect of combining rubber separation characteristics at a set speed of 580 RPM, the first roller diameter of 1⅜ inches, and a 5-degree bank angle with rubber re-feed on a first pass and second pass from re-running of the first pass rubber fraction.

TABLE E1

Preliminary separation compositions of PP/PE Concentrate using the roller separation system.
PP/PE Concentrate

| | Starting Material fraction % | Plastic Rich fraction % | Rubber Rich fraction % |
|---|---|---|---|
| Plastic | 68.8 | 84.0 | 18.7 |
| Rubber | 23.9 | 8.1 | 76.1 |
| Rigid Urethane | 3.4 | 4.1 | 1.4 |
| Wood | 2.3 | 2.8 | 0.7 |
| Non-Polymer | 1.6 | 1.0 | 3.1 |
| Metal | 0.0 | 0.0 | 0.0 |
| Total | 100 | 100 | 100 |

TABLE E2

Preliminary separation compositions of ABS Concentrate using the roller separation system.
Filled-ABS Concentrate

| | Starting Material fraction % | Plastic Rich fraction % | Rubber Rich fraction % |
|---|---|---|---|
| Plastic | 36.2 | 65.3 | 5.7 |
| Rubber | 39.5 | 7.1 | 73.4 |
| Rigid Urethane | 10.6 | 15.3 | 5.7 |
| Wood | 13.0 | 11.9 | 14.2 |
| Non-Polymer | 0.7 | 0.4 | 1.0 |
| Metal | 0.0 | 0.0 | 0.0 |
| Total | 100 | 100 | 100 |

TABLE E3

Preliminary separation compositions of the PP/PE Purification Step Reject Material using the roller separation system.
Reject Stream from PP/PE Purification

| | Starting Material fraction % | Plastic Rich fraction % | Rubber Rich fraction % |
|---|---|---|---|
| Plastic | 38.8 | 58.7 | 3.7 |
| Rubber | 46.2 | 20.7 | 91.2 |
| Rigid Urethane | 6.1 | 8.0 | 2.6 |
| Wood | 8.6 | 12.1 | 2.5 |
| Non-Polymer | 0.3 | 0.4 | 0.0 |
| Metal | 0.0 | 0.0 | 0.0 |
| Total | 100 | 100 | 100 |

TABLE E4

Preliminary separation compositions of ABS/PC Concentrate using the roller separation system.
PC-ABS/PC Alloy Concentrate

| | Starting Material fraction % | Plastic Rich fraction % | Rubber Rich fraction % |
|---|---|---|---|
| Plastic | 39.3 | 77.3 | 6.6 |
| Rubber | 56.9 | 15.1 | 92.9 |
| Rigid Urethane | 3.3 | 7.2 | 0.0 |
| Wood | 0.4 | 0.4 | 0.5 |
| Non-Polymer | 0.3 | 0.0 | 0.1 |
| Metal | 0.0 | 0.0 | 0.0 |
| Total | 100 | 100 | 100 |

While the present invention has been described with reference to the details of the embodiments of the invention shown in the drawing, these details are not intended to limit the scope of the invention as claimed in the appended claims.

What is claimed is:

1. An apparatus for separating elastomeric materials from mixed material streams comprising:

a separator including a bank of parallel rollers extending longitudinally between a first end and a second end; said bank of parallel rollers having a predefined inclination with said first end being elevated higher than said second end; said bank of parallel rollers being cooperatively rotated together;

a feed supply of mixed material streams being fed onto a top surface near said first end of said inclined parallel rollers; said mixed material streams including a first material having less friction and elasticity; and a second material having a higher friction coefficient;

a speed of said bank of cooperatively rotated parallel rollers being selectively provided to affect elastomeric material separation based upon said mixed material streams; said bank of cooperatively rotated parallel rollers gripping and moving said second material generally perpendicular to said rotating rollers; said bank of cooperatively rotated parallel rollers carrying said first material longitudinally in respective valleys between adjacent rollers of said roller bank;

a first collection bin positioned adjacent the second, lower end of the roller bank for collecting said first material sliding down said inclined roller bank top surface; and a second collection bin positioned adjacent one side of said bank parallel to the longitudinal roller axis for collecting said second material gripping said rollers and being moved generally perpendicular to said rotating rollers.

2. The apparatus for separating elastomeric materials from mixed material streams as recited in claim 1 wherein said speed is selectively provided in a range between about 300 revolutions per minute (RPM) and 950 RPM.

3. The apparatus for separating elastomeric materials from mixed material streams as recited in claim 1 wherein said bank of parallel rollers having said predefined inclination being selectively provided to affect material separation based upon said mixed material streams.

4. The apparatus for separating elastomeric materials from mixed material streams as recited in claim 3 wherein said predefined inclination is selectively provided in a range between about 2.5 degrees and 10 degrees.

5. The apparatus for separating elastomeric materials from mixed material streams as recited in claim 1 wherein said rollers are formed of carbon steel.

6. The apparatus for separating elastomeric materials from mixed material streams as recited in claim 1 wherein a deck geometry including a selected number of said parallel rollers and a selected length of said parallel rollers of said bank of parallel rollers is selectively provided to change material flow characteristics for certain mixed material streams.

7. The apparatus for separating elastomeric materials from mixed stream materials as recited in claim 1 wherein said parallel rollers are closely spaced to substantially prevent mixed stream materials from falling between said rollers based upon said mixed material streams.

8. The apparatus for separating elastomeric materials from mixed material streams as recited in claim 1 wherein said parallel rollers are closely spaced to allow predefined small thin objects to fall between said rollers based upon said mixed material streams.

9. The apparatus for separating elastomeric materials from mixed material streams as recited in claim 1 wherein a roller diameter for said bank of cooperatively rotated parallel rollers is selectively provided to affect material separation based upon said mixed material streams.

10. The apparatus for separating elastomeric materials from mixed material streams as recited in claim 9 wherein said roller diameter for said bank of cooperatively rotated parallel rollers is selectively provided in a range between 1 and 1⅜ inches.

11. A method for separating elastomeric materials from mixed material streams comprising the steps of:

providing a separator including a bank of parallel rollers extending longitudinally between a first end and a second end; said bank of parallel rollers having a predefined inclination with said first end being elevated higher than said second end;

cooperatively rotating said bank of parallel rollers together;

feeding a feed supply of mixed material streams onto a top surface near said first end of said inclined parallel rollers; said mixed material streams including a first material having less friction and elasticity; and a second material having a higher friction coefficient;

selectively providing a speed of said bank of cooperatively rotated parallel rollers to affect elastomeric material separation based upon said mixed material streams;

said bank of cooperatively rotated parallel rollers, gripping and moving said second material generally perpendicular to said rotating rollers, and carrying said first material longitudinally in respective valleys between adjacent rollers of said roller bank;

providing a first collection bin positioned adjacent the second, lower end of the roller bank and collecting said first material sliding down said inclined roller bank top surface; and providing a second collection bin positioned adjacent one side of said bank parallel to the longitudinal roller axis and collecting said second material gripping said rollers and being moved generally perpendicular to said rotating rollers.

12. The method for separating elastomeric materials from mixed material streams as recited in claim 11 wherein said speed is selectively provided in a range between about 300 revolutions per minute (RPM) and 950 RPM.

13. The method for separating elastomeric materials from mixed material streams as recited in claim 11 includes selectively providing said predefined inclination of said bank of cooperatively rotated parallel rollers to affect material separation based upon said mixed material streams.

14. The method for separating elastomeric materials from mixed material streams as recited in claim 13 wherein said predefined inclination is selectively provided in a range between about 2.5 degrees and 10 degrees.

15. The method for separating elastomeric materials from mixed material streams as recited in claim 11 includes selectively providing a roller material based upon said mixed material streams, wherein said rollers are formed of carbon steel.

16. The method for separating elastomeric materials from mixed material streams as recited in claim 11 includes selectively providing a roller diameter for said bank of cooperatively rotated parallel rollers based upon said mixed material streams.

17. The method for separating elastomeric materials from mixed material streams as recited in claim 11 includes selectively providing a deck geometry including a selected number of said parallel rollers and a selected length of said parallel rollers of said bank of parallel rollers based upon said mixed material streams.

18. The method for separating elastomeric materials from mixed material streams as recited in claim 11 includes providing said parallel rollers closely spaced together to substantially prevent materials from falling between said rollers based upon said mixed material streams.

* * * * *